US006088049A

United States Patent [19]

Austin et al.

[11] Patent Number: 6,088,049

[45] Date of Patent: Jul. 11, 2000

[54] CLAM SHELL PRINTER

[75] Inventors: Pixie Ann Austin; Christopher A. Wiklof; Cathy L. Aragon, all of Everett, Wash.

[73] Assignee: Intermec IP Corporation, Beverly Hills, Calif.

[21] Appl. No.: 09/015,676

[22] Filed: Jan. 29, 1998

Related U.S. Application Data

[63] Continuation of application No. 08/454,503, May 30, 1995, Pat. No. 5,751,330.

[51] Int. Cl.[7] ..... B41J 2/32

[52] U.S. Cl. ..... 347/222

[58] Field of Search ..... 347/171, 222; 400/691, 693

[56] References Cited

U.S. PATENT DOCUMENTS

| | | | |
|---|---|---|---|
| 3,713,168 | 1/1973 | Baker | 346/74 E |
| 3,767,020 | 10/1973 | Rowe . | |
| 4,372,695 | 2/1983 | Ross | 400/119 |
| 4,427,314 | 1/1984 | Fujiwara et al. | 400/338.2 |
| 4,433,925 | 2/1984 | Fujiwara et al. | 400/88 |

(List continued on next page.)

FOREIGN PATENT DOCUMENTS

| | | | |
|---|---|---|---|
| 61-035391 | 2/1986 | Japan . | |
| 63-290780 | 11/1988 | Japan . | |
| 4-296569 | 10/1992 | Japan | 347/222 |

OTHER PUBLICATIONS

"Axiohm A793 Clamshell™ Thermal Receipt Printer," Axiohm, Inc. Webstie: www.axiohm.com, Copyright 1997, 2 pp.

"Eltron LP2442," Eltron International, Inc. Preliminary Article, Dec. 17, 1997, 3 pp.

"Eltron Bar Code & Label Printers," McBride Computer Services, Webstie: http://www.dmcbride.com/eltron.htm, Dec. 16, 1997, pp 1–3.

"Low Cost Direct Thermal and Thermal Transfer Label Printers," Eltron International, Inc., Website: http://www, eltron.com, 2 pp.

"Eltron TLP–2242 Thermal Transfer," Raco Industries, Website: http://www.racoindustries.com/tlp2242.htm, Dec. 16, 1997, pp 1–2.

Slattery, Dennis, "Eltron™ Bar Code Label Printers And More . . . ," Eltron International, Inc., Website: http://www.eltron.com, Dec. 16, 1997, 1 p.

(List continued on next page.)

*Primary Examiner*—Huan Tran
*Attorney, Agent, or Firm*—Perkins Coie LLP

[57] ABSTRACT

A printer for printing on an outer layer of a print medium on a print medium roll. The printer includes a base and a cover, which are pivotally coupled in a "clamshell" configuration for movement between a closed position in which the printhead is located in a printing position proximate the path of the media and an open position that is spaced from the printing position. The printer may use thermal or inkjet printing. The printer is used without a mechanical paper drive mechanism. The printer monitors movement of an outer wrap of the print medium as the print medium roll rotates in response to a user pulling print medium from the print medium roll. In one embodiment, the printer detects movement of the print medium with a metering roller and an optical rotation sensor. In another embodiment, the printer monitors movement of the print medium by detecting movement of index marks on the print medium. From the monitored movement of the print medium, the printer identifies a portion of the print medium aligned to the printhead and selects image portions to print in the identified portion. The printer then activates the printhead to print the selected image portions in the corresponding identified portion. A bias spring, together with movable mounting of the printhead, allows the printhead to remain engaged with the print medium as the radius of the print medium roll decreases as the print medium is dispensed.

27 Claims, 5 Drawing Sheets

U.S. PATENT DOCUMENTS

| | | | |
|---|---|---|---|
| 4,523,235 | 6/1985 | Rajchman | 358/256 |
| 4,547,780 | 10/1985 | Cummins | 346/9 |
| 4,614,949 | 9/1986 | Hakkaku et al. | 346/76 PH |
| 4,639,739 | 1/1987 | Tsutsumi | 346/76 PH |
| 4,641,980 | 2/1987 | Matsumoto et al. | 347/222 |
| 4,699,052 | 10/1987 | Lemelson | 101/110 |
| 4,750,049 | 6/1988 | Murakami et al. | 358/296 |
| 4,819,083 | 4/1989 | Kawai et al. | 358/294 |
| 4,851,896 | 7/1989 | Muranaga et al. | 358/443 |
| 4,851,921 | 7/1989 | Sato et al. | 358/473 |
| 4,862,281 | 8/1989 | Sato et al. | 358/400 |
| 4,868,676 | 9/1989 | Matsuura et al. | 358/296 |
| 4,887,165 | 12/1989 | Sato et al. | 358/474 |
| 4,894,730 | 1/1990 | Yanagawa et al. | 358/473 |
| 4,899,228 | 2/1990 | Sano et al. | 358/473 |
| 4,903,232 | 2/1990 | O'Connell et al. | 364/900 |
| 4,915,027 | 4/1990 | Ishibashi et al. | 101/486 |
| 4,928,183 | 5/1990 | Yajima | 358/296 |
| 4,947,262 | 8/1990 | Yajima et al. | 364/519 |
| 4,949,283 | 8/1990 | Yamauchi et al. | 364/519 |
| 4,999,016 | 3/1991 | Suzuki et al. | 400/88 |
| 5,020,928 | 6/1991 | Akiyama et al. | 400/193 |
| 5,024,541 | 6/1991 | Tsukada et al. | 400/88 |
| 5,052,832 | 10/1991 | Akiyama et al. | 400/120 |
| 5,079,639 | 1/1992 | Mochinaga | 358/473 |
| 5,112,149 | 5/1992 | Suenaga | 400/88 |
| 5,131,090 | 7/1992 | Fukushima | 395/700 |
| 5,150,130 | 9/1992 | Sato | 346/76 PH |
| 5,240,334 | 8/1993 | Epstein et al. | 400/88 |
| 5,366,302 | 11/1994 | Masumura et al. | 400/120.16 |
| 5,694,159 | 12/1997 | Kajiya et al. | 347/197 |
| 5,751,330 | 5/1998 | Austin et al. | 347/222 |

OTHER PUBLICATIONS

"What's New At Eltron," Eltron International, Inc. Website: http://www.eltron.com/newl.htm, pp. 1–2.

"The New Eltron Companion™ Series," Eltron Internationa, Inc., Website: http://www.eltron.com/eltron, 2 pp.

"Eltron Companion+ Direct Thermal Label Printers Features/Pricing/Photo," Raco Industries, Website: http://www.racoindustries.com/comppf.htm, Dec. 16, 1997, pp 1–2.

CLAM SHELL PRINTER

CROSS-REFERENCE TO RELATED APPLICATION

This application is a continuation of U.S. patent application Ser. No. 08/454,503, filed May 30, 1995, now U.S. Pat. No. 5,751,330.

TECHNICAL FIELD

The present invention relates to printers such as printers used for printing bar code symbologies and other images.

BACKGROUND OF THE INVENTION

Typically, printers require a supply of a print medium, such as paper, to be loaded into the printer and controllably moved through the printer. The paper is typically supplied as either a continuous stream of paper or as individual sheets. The paper is fed into the printer using a set of drive rollers which frictionally engage the paper and propel it through the printer along a predetermined path. The drive rollers often are driven by a stepper motor which drives the drive rollers in small increments or steps such that the paper is propelled incrementally or stepped through the printer, pausing slightly between each step. As the paper is stepped through the printer, it passes a conventional printhead having a linear array of elements, such as a thermal printhead or an inkjet printhead. During each pause between steps, a small portion of the paper is aligned with the printhead and selected elements of the printhead are activated to produce a portion of an image on the portion of the paper aligned with the printhead.

This image portion is a small portion of an entire image to be printed. The entire image typically is produced by stepping the paper past the printhead, pausing the paper after each step, determining a step number (e.g., fifth step or sixth step) corresponding to the pause, determining the portion of the image corresponding to the step number, determining which elements of the printhead to activate to produce the determined portion of the image, and activating the determined elements to produce the determined portion of the image on the paper. A microprocessor controls the operation.

To produce the entire image accurately, the distance the paper is propelled for each step must be controlled precisely. Further, the step number must be monitored continuously to enable the location of the paper relative to the printhead to be precisely determined.

This control of the paper position and monitoring of the step number is typically achieved with a stepper motor with precisely defined step sizes and by digitally controlling the stepper motor with a microprocessor motor controller. The timing of the printer must also be controlled accurately, so that the printhead is activated during the pauses between steps.

The need for such stepper motors, digital controllers and timing control greatly increase the weight, complexity and cost of printers. Also, monitoring the step number and correlating it to the controlled stepping of the stepper motor and the image portion requires considerable microprocessor time.

SUMMARY OF THE INVENTION

The present invention overcomes the limitations of the prior art by providing a printer capable of printing relatively complex images of indefinite and variable size and a high degree of uniformity directly onto a print medium on a print roll without requiring an accurately controlled stepper motor or other mechanical print medium or other controllable print media feed source with its associated weight, complexity, cost, and interface and processing requirements.

The print medium may be propelled by hand from outside of the printer. The means of propelling the print medium through the printer is independent of electronic control by the printer. By divorcing the print medium driving means from the printer electronic control, the printer eliminates the need for a printer-to-print medium drive interface.

The printer in its preferred embodiment determines the position of the print medium mechanically by engaging a first roller to an outer wrap of the print medium roll and coupling the first roller to a rotational sensor. Based upon the detected rotation of the print medium roll, the printer identifies a small field on the outer layer of the print medium aligned with the printhead and a corresponding image portion to be printed on the field. The printhead is then energized in response to the identified image portion to print the image portion. The process is repeated for successive image portions until an entire image is printed.

In an alternative embodiment, the printer measures the print medium position by optically monitoring index marks on the print medium roll. The printer then calculates the position of the print medium from these measurements.

Because the printer detects the position of the print medium directly, no mechanical print medium drive or other controllable print media feed source is required. The printed image achievable with the printer is not limited in size to the printing element size. Because the printer uses an accurate, location-based printhead activation, it provides a uniform, repeatable image. The printer can therefore be used to print bar codes and other images of varying lengths.

DETAILED DESCRIPTION OF THE INVENTION

Figures 1A, 1B:
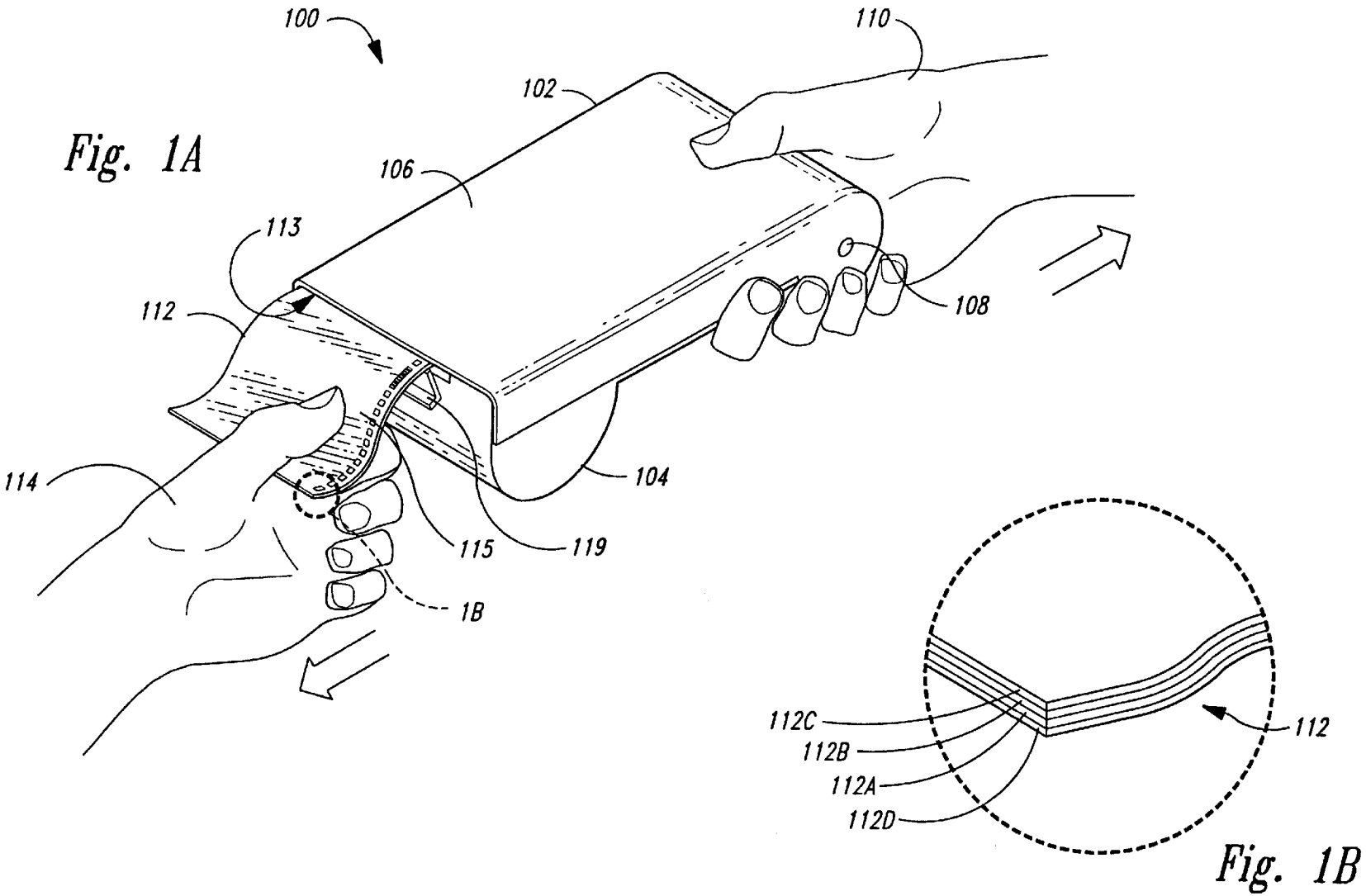
FIG. 1A is an isometric view of a preferred embodiment of the inventive printer showing a user pulling a print medium from the printer.
FIG. 1B is an enlarged detail view of a portion of the print medium of FIG. 1A showing four layers of the print medium.

A printer 100 according to the present invention, shown in FIG. 1A includes a housing 102 having a base 104 and a cover 106 pivotably connected together by a pivot pin 108 in a "clamshell" configuration. The housing 102 has a curved shape for ease of grasping by a first hand 110 of a user.

As will be seen from the following discussion, the printer 100 does not require a stepper motor and associated control electronics to print an image. Instead, the printer 100 detects motion of a print medium 112 as it is pulled through a paper port 113 from the printer 100 by a second hand 114 of the user, which grabs a free end 115 of the print medium 112. Based upon the detected motion of the print medium 112 as it is being pulled, the printer 100 identifies successive portions of the print medium 112 and prints a portion of an image on each successive print medium portion. Together, the successive image portions form an entire image, such as a bar code symbol.

Figure 2:
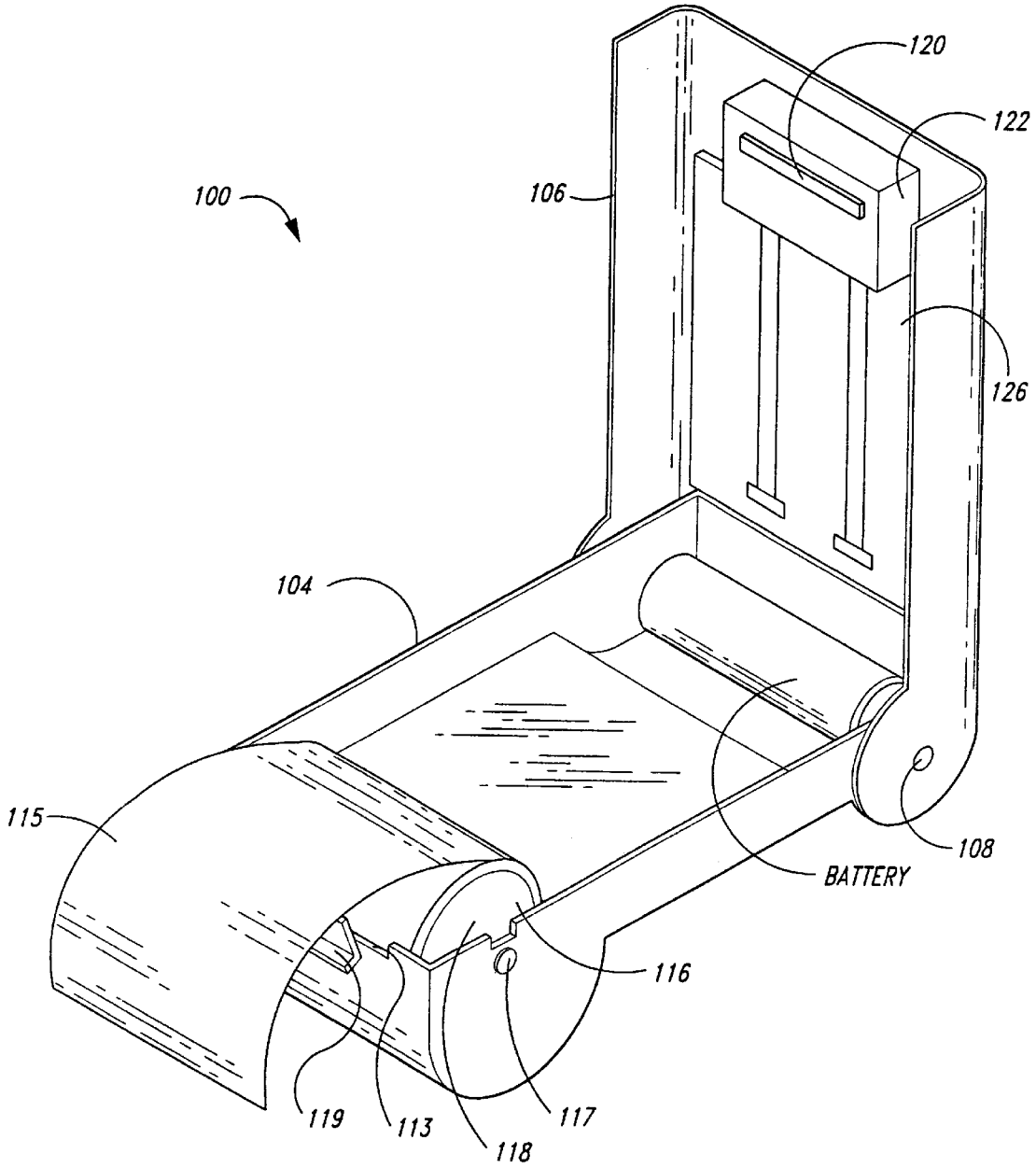
FIG. 2 is an enlarged isometric view of the printer of FIG. 1 with a cover open to expose internal components of the printer.

The printer 100 of FIG. 1A is presented in FIG. 2 with the cover 106 rotated about the pivot pin 108 to its open position to expose the internal components of the printer. A print medium roll 116 on which the print medium 112 originally resides is carried by the base 104 and rotatably supported by a roll axle 117 to provide a continuous length of the print medium 112. The print medium 112 is a linerless thermal medium having a series of labels linked end-to-end. The print medium 112 is wound around a hollow cylindrical core 118 to form the print medium roll 116. The core 118 is rotatably carried by the roll axle 117, which passes through the hollow center of the core, providing support while allowing the print medium roll 116 to rotate as the print medium 112 is dispensed.

As can be seen in FIG. 1B, the linerless thermal print medium 112 is a four-layer structure having as its middle two layers a paper base layer 112A with a thermally sensitive top layer 112B. A radiation-cured silicone coating 112C (shown to exaggerated scale) forms a protective shield to protect the thermally sensitive top layer 112B. A description of such a linerless thermal print medium can be found in U.S. Pat. No. 4,604,635 to Wiklof et al., which is incorporated herein by reference. An adhesive 112D (shown to exaggerated scale) coats the lower surface of the paper base layer 112A to allow the print medium 112 to be attached to a package or other object.

Alternatively, a thermally sensitive print ribbon with a ribbon take-up roll, as is conventional for thermal printers, may be used in conjunction with a conventional paper in place of the linerless thermal print medium. Moreover, while a printhead 122 used in the printer 100 is preferably a thermal printhead, other printing heads, such as inkjet printheads may be used. In such embodiments, the print medium 112 need not include a thermally sensitive layer or ribbon.

The print medium 112 that is dispensed from the print medium roll 116 exits the housing 102 through the label port 113 formed between the base 104 and the cover 106 where the free end 115 is accessible for grasping by the second hand 114 of the user to pull the print medium 112 from the print medium roll. To tear away sections of the print medium 112 the user pulls downwardly on the print medium, forcing the print medium against a tear bar 119 carried by the base 104 adjacent to the label port 113. The tear bar 119 is a sharpened metal bar similar to a tear bar on a common transparent tape dispenser.

Figure 3:
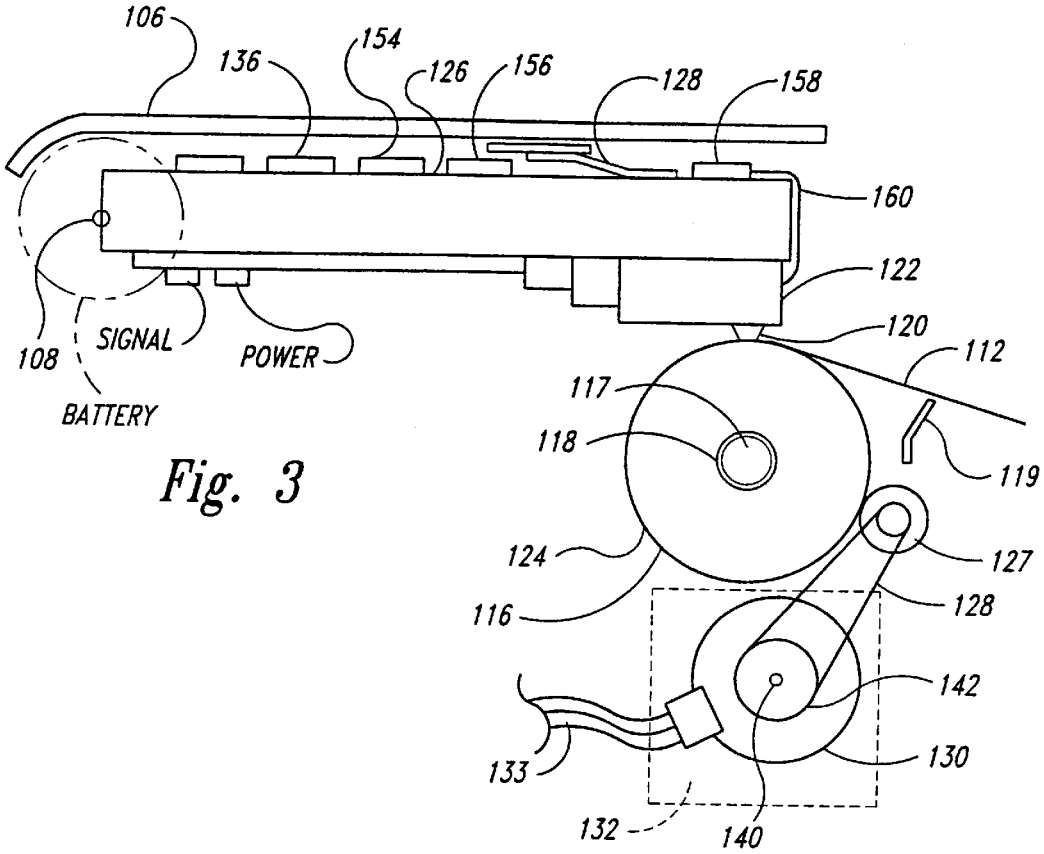
FIG. 3 is a schematic side elevational drawing of a portion of the printer of FIG. 1 showing the printhead resiliently engaging an outer layer of a print medium roll.

As can be seen in the detail view of the printing and motion-monitoring portion of the printer 100 shown in FIG. 3, the cover 106 carries a linear array of print elements 120 within the conventional thermal printhead 122 on a printed circuit board 126. When the cover 106 is closed, the array of print elements 120 engages an outer wrap 124 of the print medium 112 at the silicone coating 112C. The printhead 122 is held in thermal contact with the print medium 112 by engagement pressure between the printhead and the print medium roll 116.

To maintain the engagement of the printhead 122 with the print medium 112, the printed circuit board 126 bearing the printhead is movably supported by the cover 106 and biased to move toward the print medium roll 116 by a spring 128 positioned between the cover and the printed circuit board. As the user pulls the print medium 112 from the printer 100, the print medium is consumed and the diameter of the print medium roll 116 is reduced. The biasing force of the spring 128 causes the printed circuit board 126 carrying the printhead 122 to move toward the print medium roll 116 with the printhead aligned to move on a radial path toward the print roll axle 117 with the printhead 122 remaining engaged with the print medium roll 116.

The printing process used by the printer 100 may be divided into three related aspects, first, detection of movement of the print medium 112 to determine the portion of the print medium aligned with the printhead 122; second, identification of an image portion to be printed on the determined portion of the print medium; and third, activation of the printhead to print the image portion on the determined portion of the print medium.

The first aspect of the printing process, detection of the print medium movement, is initiated when the print medium 112 is pulled by the user's second hand 114 which grasps and pulls the protruding free end 115 of the print medium 112, causing the print medium roll 116 to turn. The rotation of the print medium roll 116 is translated through frictional engagement to rotation of a metering roller 127 as shown in FIG. 3. In turn, rotation of the metering roller 127 is translated by a belt 128 into rotation of an encoder wheel 130 within a rotation sensor 132. In the manner discussed in greater detail below with respect to FIG. 4, the rotation sensor 132 converts the rotational movement of the metering roller 127 and corresponding rotation of the encoder wheel 130 into a digital electrical signal indicative of rotation of the print medium roll 116. The digital signal from the rotation sensor 132 is carried by a cable 133 to the printed circuit board 126. There, the digital signal is input to a microprocessor 136 on the printed circuit board 126. The microprocessor 136 decodes the digital signal indicative of the rotation of the print medium roll 116 and from the decoded information, determines the portion of the print medium 112 aligned to the printhead 122.

Figure 4:
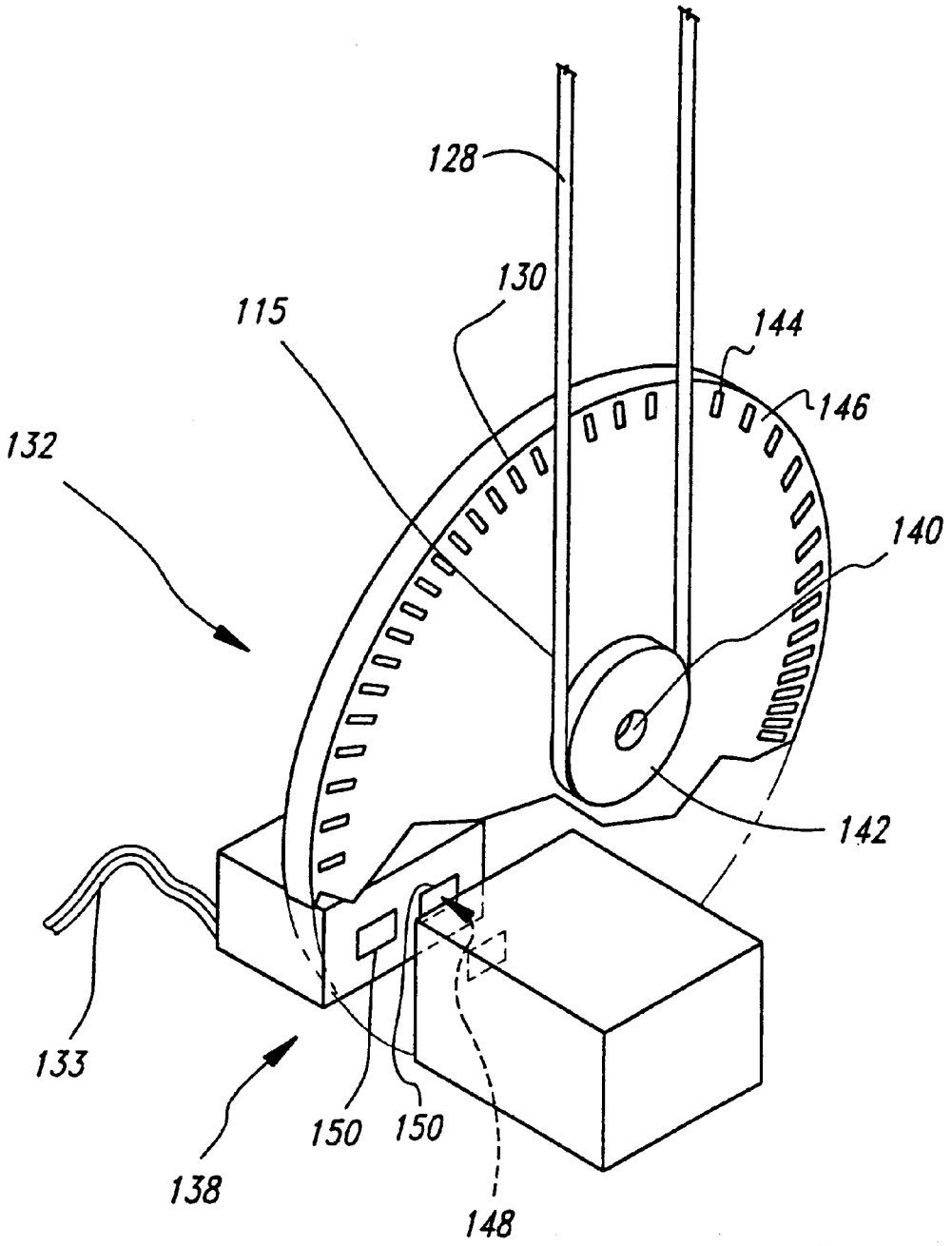
FIG. 4 is an enlarged fragmentary view of a rotation sensor used in the printer of FIG. 1.

The measurement of rotation of the print medium roll 116 by the rotation sensor 132 is best demonstrated by reference to FIG. 4. The rotation sensor 132 includes two main components, the encoder wheel 130 and an optical detector 138 for monitoring the rotation of the encoder wheel. The encoder wheel 130 is mounted on an encoder axle 140 coaxially with an encoder pulley 142. The encoder pulley 142 is coupled to the metering roller 127 (FIG. 3) by the belt 128 to turn in correspondence with the metering roller. As the print medium roll 116 turns, the metering roller 127 is turned through its frictional engagement with the print medium roll. As the metering roller 127 turns, the encoder pulley 142 and encoder wheel 130 turn with it.

Alternating transmissive and opaque regions 144 and 146, respectively, are circumferentially spaced along the perimeter of the encoder wheel 130. The optical detector 138 includes an optical source 148 (shown in broken line) and a pair of optical receivers 150 to monitor the movement of the transmissive and opaque regions 144 and 146, giving an indication of rotation of the encoder wheel 130. The optical source 148 and optical receivers 150 are a conventional light-emitting diode (LED) and photo detectors, respectively, which are positioned such that the transmissive and opaque regions 144 and 146 of the encoder wheel 130 pass between the optical source and receivers. As the encoder wheel 130 turns, light from the optical source 148 is alternately transmitted through the transmissive regions 144 to the receivers 150 and blocked by the opaque regions 146 producing an alternating light signal to the receivers 150. In response to the alternating light, the receivers 150 produce signals corresponding to the angular rotation of the encoder wheel 130 which correspond to the rotation of the print medium roll 116. The rotation sensor 132 thus produces an electrical signal indicative of the rotation of the print medium roll 116 for input to the microprocessor 136 (see FIG. 3).

Referring again to FIG. 3, the microprocessor 136 monitors the signals from the rotation sensor 132 and calculates the distance traveled by the print medium 112. To calculate the distance traveled by the print medium 112, the microprocessor 136 first identifies a starting location, such as the start of a label or an arbitrarily selected start of an image location. The microprocessor 136 then monitors the signals from the rotation sensor 132 to calculate the distance traveled by the print medium.

From the determination of the traveled distance, the microprocessor 136 determines when successive portions of the print medium 112 are aligned with the printhead 122 for printing. The microprocessor 136 then determines a desired image portion to be printed on each successive portion of the print medium 112 and identifies an appropriate energization signal for the printhead 122 to produce the desired image portion.

To identify the desired image portion to be printed, the microprocessor 136 retrieves data from a bit map of image data stored in a memory 154 having several memory locations, each corresponding to a pixel of the image. Each memory location contains a data bit or sequence of data bits corresponding to the memory location's respective individual pixel, with each such data bit or sequence of data bits representing the printing or not printing of the pixel. For example, a logic level "1" may correspond to printing the particular pixel and a logic level "0" may correspond to not printing the particular pixel. The pixels of the image thus map in a one-to-one relationship to locations in the memory 154 containing data bits (i.e., a "bitmap").

The data is retrieved from the memory 154 on a line-by-line basis. That is, a data bit or sequence of data bits for each element in the array of print elements 120 of the printhead 122 is retrieved and loaded as a group into a buffer 156 for printing. The portion of the print medium 112 with which the printhead 122 is aligned contains a plurality of regions, each aligned to one of the print elements 120. All of the print elements 120 may be activated simultaneously to print a narrow portion (i.e., a line) of the image, with each of the regions representing a single pixel of the image to be printed (or not printed) while the printhead 122 is aligned to the portion of the print medium 122. The microprocessor 136 determines whether or not to print each pixel based upon the determination of the portion of the print medium 112 to which the printhead 122 is aligned, and the position of each print element 120 in the printhead 122.

To actually print the desired portion of the image, the data bits or sequences of data bits retrieved from the memory location of the memory 154 corresponding to the particular pixels in the desired image portion are sent to the buffer 156 and clocked into a printer driver 158 under control of the microprocessor 136. The printer driver 158 then provides an energization signal to all of the print elements 120 in the printhead 122 through a printhead cable 160. In the thermal printhead of the preferred embodiment, the printer driver 158 includes current drivers and complementary logic components in accordance with conventional design.

The printer driver 158 is driven by the retrieved data in combination with a system clock signal under control of the microprocessor 136 to ensure proper timing and spacing of successive desired portions of the image to be printed. The microprocessor 136 controls the spacing of successive desired portions of the image by first monitoring the temporal spacing between successive increments of rotation of the print medium roll 116 to calculate the velocity of the print medium 112 past the printhead 122, averaged over several recent intervals. Based upon the average velocity, the microprocessor 136 estimates, in advance, when the printhead 122 will be aligned to each successive portion of the print medium 122. Based upon the calculation, the microprocessor 136 activates the printhead 122 before the portion of the print medium 112 to be printed actually reaches the printhead 122, so that the print elements 120 will have sufficient time to heat to a printing temperature before the portion of the print medium 112 passes the printhead 122.

As each individual print element 120 is heated, the region of the print medium 112 aligned to a particular print element is heated. The heat from the print element activates the thermally sensitive layer 112B of the print medium 122 and produces the desired portion of the printed image. Because the printhead 122 is mounted to the printed circuit board 126 which is movably mounted to the cover 106, the printhead can move radially inward toward the print roller 117 to accommodate decreases in the radius of the print medium roll 116 as the print medium 112 is consumed.

Figure 5:
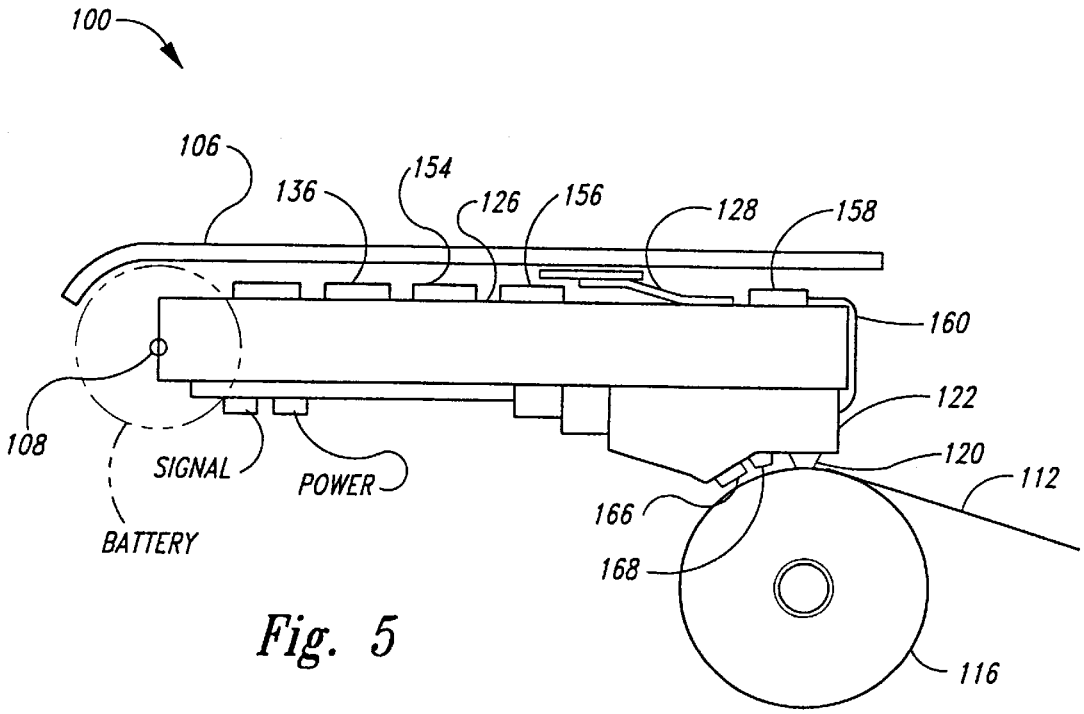
FIG. 5 is a schematic side elevational drawing of an alternative embodiment of the printer of FIG. 1 using optically detected index marks to monitor movement of the print medium roll.
Figure 6:
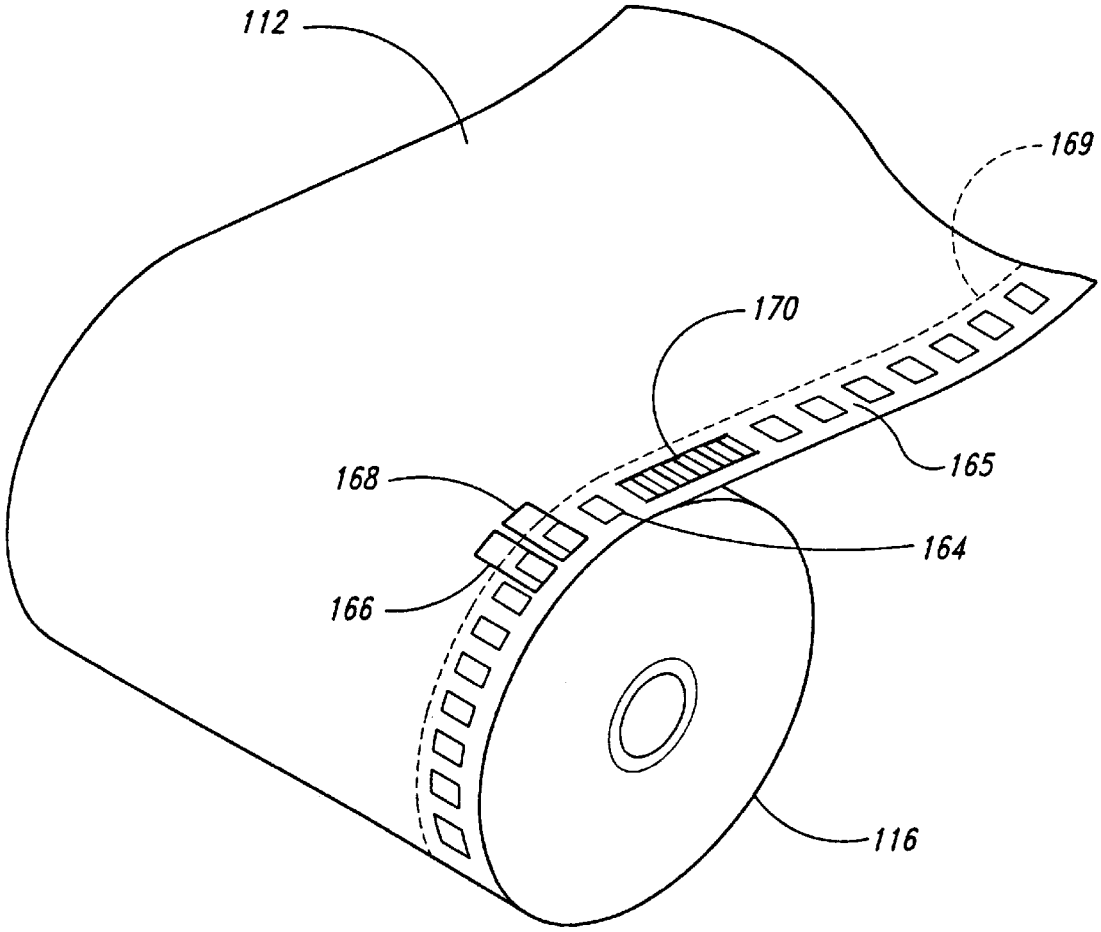
FIG. 6 is an enlarged isometric view of the print medium roll and an optical monitor of the printer of FIG. 5 showing index marks printed on the rolls.

An alternative embodiment of the printer 100 shown in FIG. 5 monitors movement of the print medium 112 by optically monitoring index marks 164 which are printed directly on the print medium 112 at evenly spaced locations along an edge region 169 of the print medium 112 with unmarked portions 165 therebetween, as shown in FIG. 6. To monitor movement of the index marks, the printer 100 includes an optical emitter 166 and detector 168. The emitter 166 and detector 168 are mounted to the printhead 122 and are thus carried by the printed circuit board 126 as it moves to accommodate changes in the radius of the print medium roll 116. The emitter 166 and detector 168 are fixedly mounted with the emitter 166 oriented to emit light toward the edge region 169 of the print medium 112 and the detector 168 positioned to detect light from the emitter 166 which is reflected from the edge region 169. Because the index marks 164 are areas of lower reflectance than the reflectance of the unmarked portions 165 therebetween, the intensity of light from the emitter 166 that is received will be more effectively reflected by the unmarked portions 165 of the edge region 169. Accordingly, the intensity of light received by the detector 168 will depend upon whether light from the emitter 166 strikes an index mark 164 or an unmarked portion 165 of the print medium 112.

As the print medium 112 is dispensed, the print medium roll 116 will rotate and the index marks 164 and unmarked portions 165 move past the emitter 166 and the detector 168. Light from the emitter 166 is alternately reflected by the unmarked portions 165 of the print medium 112 and absorbed by the index marks 164, causing the intensity of light received by the detector 168 to vary. In response to the alternating light, the detector 168 produces electrical signals corresponding to motion of the print medium 112 for input to the microprocessor 136 (FIG. 3). As with the embodiment of FIGS. 14, the microprocessor 136 monitors the signals from the detector 168 and calculates the distance traveled by the print medium 112 with reference to a selected starting point.

Advantageously, the print medium 112 in this embodiment bears a start-of-field mark 170 to indicate the start of a label or other selected printing field. When the microprocessor receives an electrical signal from the detector 168 corresponding to the start-of-field mark 170, the microprocessor 136 references subsequent movements to the start-of-field, identifying the image portion to be printed.

While the printer 100 is described herein as printing symbologies, such as bar code symbols or two-dimensional symbologies on labels, the printer may use other print media, such as paper from a paper roll or separate sheets of paper. The printer 100 may also be used to print other images such as text or graphics.

Also, the printhead 112 may be fixedly mounted on either of the base 104 or the cover 106 with the cover biased to pivot toward the base. As print medium 122 is consumed and the radius of the print medium roll 116 decreases, the cover 106 pivots toward the base 104, carrying the printhead 122 radially inward toward the print roll axle 117.

The contents of applicant's prior filed and commonly assigned patent application U.S. Ser. No. 08/454,503, filed May 30, 1995, are incorporated by reference herein. It will be appreciated that, although specific embodiments of the invention have been described herein for purposes of illustration, various modifications may be made without departing from the spirit and scope of the invention. For example, the index marks 164 may be read using ambient light in some environments. Similarly, the printhead 122 may be carried by the base 104 rather than the cover 106 and rotation of the print medium roll 116 may be monitored by directly monitoring rotation of the core 118. Accordingly, the invention is not limited except as by the appended claims.

We claim:

1. A printer for printing on a print medium, the printer comprising:

a housing including a first housing portion and a second housing portion pivotally coupled to the first housing portion for movement between a closed position and an open position with respect to the first housing portion;

a user propelled print medium supply receivable in the housing and supportable therein by the second housing portion for movement along a print medium path;

a printed circuit board received in the housing and coupled to the first housing portion for movement therewith;

a print head received in the housing opposed to the print medium, the print head mounted to the printed circuit board and coupled thereby to the first housing portion for movement therewith between a printing position proximate the print medium path when the second housing portion is in the closed position and a position spaced from the printing position when the second housing portion is in the open position; and a microprocessor mounted on the printed circuit board in controlling communication with the printhead.

2. The printer of claim 1, further comprising:

a spring received in the housing and positioned to bias the printhead into the printing position.

3. The printer of claim 1 wherein the printing position is in thermal contact with the print medium.

4. A printer for printing on media, the printer comprising:

a housing including a first housing portion carrying a printed circuit board, a control circuit and a printhead mounted to the printed circuit board for movement therewith, the printhead electrically coupled to the control circuit, and a second housing portion carrying a print medium supply, the second housing portion pivotally coupled to the first housing portion for defining a print medium path therebetween when the second housing portion is in a closed position with respect to the first housing portion, and for providing access to the printed circuit board, the printhead, control circuit, and the print medium supply when the second housing portion is in an open position with respect to the first housing portion.

5. The printer of claim 4 wherein the control circuit comprises:

a microprocessor.

6. A printer for printing an image on a print medium, the printer comprising:

a housing, the housing having a base and a cover, the cover pivotally mounted to the base for movement between a closed position and an open position spaced from the closed position;

a print medium path defined in the housing;

a printhead, the printhead coupled to the housing such that when the cover is in the closed position the printhead is positioned in a printing position with respect to the print medium and when the cover is in the open position the printhead is spaced from the printing position with respect to the print medium; and a circuit board coupled to the housing such that when the cover is in the closed position the circuit board is inaccessible from an exterior of the housing and when the cover is in the open position the circuit board is accessible from the exterior to the housing.

7. The printer of claim 6 wherein the printing positions proximate the print media path.

8. The printer of claim 6, further comprising:

a microprocessor mounted to the printed circuit board which is received in the housing, the microprocessor in controlling communication with the printhead.

9. The printer of claim 6, further comprising:

a microprocessor mounted to the printed circuit board which is received in the housing, and wherein the printhead is mounted to the printed circuit board such that the microprocessor is in controlling communication with the printhead.

10. The printer of claim 6 wherein the printhead is mounted to the cover and the printed circuit board is mounted to the cover.

11. The printer of claim 6, further comprising a spring positioned to bias the printhead toward the printing position.

12. The printer of claim 6 wherein the printing position is in contact with the print medium.

13. The printer of claim 6, further comprising:

a power source received within the housing and electrically coupled to the printhead.

14. The printer of claim 6, further comprising:

a battery received within the housing and electrically coupled to the printhead.

15. The printer of claim 6, further comprising:

a print medium tear bar mounted to the housing proximate an exit formed in the housing.

16. A printer for printing on a print medium, the printer comprising:

a housing including a first housing portion and a second housing portion pivotally coupled to the first housing portion for movement between a closed position and an open position with respect to the first housing portion, the second housing portion defining a print medium supply receptacle for removably receiving a print medium supply;

a printhead received in the housing opposed to the print medium supply receptacle, the printhead coupled to the first housing portion for movement therewith between a printing position proximate the print medium supply receptacle when the second housing portion is in the closed position and a position spaced from the printing position when the second housing portion is in the open position, and a microprocessor coupled to a printed circuit board which is received in the housing and coupled to the first housing portion, and wherein the printhead is coupled to the printed circuit board such that the microprocessor is in controlling communication with the printhead.

17. The printer of claim 16, further comprising:

a spring received in the housing and positioned therein to bias the printhead into the printing position.

18. The printer of claim 16 wherein the printing position is proximate a print medium.

19. A printer for printing on a print medium supply, the printer comprising:

a housing including a first housing portion and a second housing portion, the first housing portion carrying a printhead and a printhead control circuit, the second housing portion removably receiving the print medium supply, the first housing portion pivotally coupled to the second housing portion for movement between a closed position in which the printhead is in a printing position that is proximate and opposed to the print medium supply, and an open position in which the printhead is spaced from the printing position sufficiently to provide access to the printhead and the control circuit.

20. The printer of claim 19 wherein the printhead control circuit comprises:

a microprocessor mounted to a printed circuit board which is received in the housing and coupled to the first housing portion, and wherein the printhead is mounted to the printed circuit board such that the microprocessor is in controlling communication with the printhead.

21. The printer of claim 19, further comprising:

a spring received in the housing and positioned to bias the printhead into the printing position.

22. The printer of claim 19 wherein the printing position is in contact with the print medium supply.

23. The printer of claim 19 wherein the printhead is movably supported by the housing to be in contact with the print medium supply when the first housing portion is in the closed position with respect to the second housing portion.

24. The printer of claim 19 wherein the printhead is movably supported by the housing to be in thermal contact with the print medium supply when the first housing portion is in the closed position with respect to the second housing portion.

25. A printer for printing on media, the printer comprising:

a housing including a first housing portion and a second housing portion pivotally coupled to the first housing portion for movement between a closed position and an open position in which an interior of the housing is exposed;

a print medium received in the housing for passage therethrough along a print medium path defined through the housing;

a microprocessor coupled to a printed circuit board which is received in the housing and coupled to the first housing portion; and a printhead received in the housing and coupled thereto for movement between a printing position in which the printhead is in contact with the print medium when the housing is in the closed position and a position where the printhead is spaced from the print medium when the housing is in the open position, wherein the printhead is mounted to the printed circuit board such that the microprocessor is in controlling communication with the printhead.

26. The printer of claim 25, further comprising:

a spring received in the housing and positioned therein to bias the printhead into contact with the print medium.

27. A printer for printing on a print medium, the printer comprising:

a housing including a base and a cover pivotally mounted to the base along a pivot axis for movement with respect thereto between a closed position and an open position, a print medium path being defined through the housing; and a printhead coupled to the cover through a printed circuit board for movement therewith about the pivot axis between a printing position in which the printhead is proximate a portion of the print medium path and a position spaced from the printing position.

* * * * *

UNITED STATES PATENT AND TRADEMARK OFFICE

CERTIFICATE OF CORRECTION

PATENT NO : 6,088,049

DATED : July 11, 2000

INVENTOR(S): Austin et al.

It is certified that error appears in the above-identified patent and that said Letters Patent are hereby corrected as shown below:

ON THE TITLE PAGE:
In the Inventors Section:

After Pixie Ann Austin should be --, Marysville--;

Column 8, line 35, "positions" should be --position is--.

Signed and Sealed this

Tenth Day of April, 2001

*Attest:*

Nicholas P. Godici

NICHOLAS P. GODICI

*Attesting Officer*

*Acting Director of the United States Patent and Trademark Office*